US005162770A

United States Patent [19]

Abele

[11] Patent Number: 5,162,770

[45] Date of Patent: Nov. 10, 1992

[54] TERMINATIONS OF CYLINDRICAL PERMANENT MAGNETS

[75] Inventor: Manlio G. Abele, New York, N.Y.

[73] Assignee: Esaote Biomedica, Genoa, Italy

[21] Appl. No.: 484,347

[22] Filed: Feb. 22, 1990

[51] Int. Cl.[5] ..... H01F 7/00; H01F 7/02

[52] U.S. Cl. ..... 335/306; 335/301

[58] Field of Search ..... 335/302, 303, 301, 304, 335/306

[56] References Cited

U.S. PATENT DOCUMENTS

| | | | |
|---|---|---|---|
| 3,205,415 | 9/1965 | Seki et al. | 335/301 X |
| 3,768,054 | 10/1973 | Neugebauer | 335/304 |
| 4,647,887 | 3/1987 | Leupold | 335/306 X |
| 4,839,059 | 6/1989 | Leupold | 335/301 |

FOREIGN PATENT DOCUMENTS

| | | | |
|---|---|---|---|
| 0177903 | 8/1987 | Japan | 335/301 |

*Primary Examiner*—Leo P. Picard
*Assistant Examiner*—Raymond Barrera
*Attorney, Agent, or Firm*—Rosen, Dainow & Jacobs

[57] ABSTRACT

A permanent magnetic structure comprising a cylindrical body (15) and a termination structure (14, 12, 10). The cylindrical body (15) is composed of magnetic material causing a magnetic field and flux of magnetic induction. The cylindrical body (15) is oriented such that the interface between the cylindrical body 15 and the termination (14, 12, 10) is parallel to the magnetic induction and the cylindrical body (15).

13 Claims, 16 Drawing Sheets

TERMINATIONS OF CYLINDRICAL PERMANENT MAGNETS

BACKGROUND OF THE INVENTION

This invention relates to permanent magnets, and particularly to termination structures for permanent magnets which do not distort the magnetic field.

A permanent magnet designed for applications such as medical clinical use is an open structure with opening dimensions dictated by the size of a human body. An open magnetic structure makes it impossible to achieve a perfectly uniform magnetic field within the region of clinical interest. Thus a major problem in magnet design is the partial compensation of the field distortion generated by the magnet opening in order to achieve the degree of uniformity dictated by the diagnostic requirements within the region of interest.

An important category of permanent magnet is a structure of permanent magnetized material designed to generate a uniform magnetic field within the cavity of the magnet and to contain the field within the volume of the magnet without the use of external magnetic yokes or magnetic shields. Materials like ferrites and high energy product rare earth alloys are suitable for this category of permanent magnets.

The two conditions of field uniformity and field confinement can be attained in cylindrical structures where the magnetic configuration consists of a series of concentric layers of magnetized material. In practice the cylindrical structure has to be truncated and the effect of the opening becomes less and less important as the length of the cylinder becomes larger and larger compared to the cylinder transversal dimensions. From a practical standpoint, the optimum design of the termination is the one that minimizes length and weight of the magnet.

It is accordingly the principal object of the invention to optimize the termination of a cylindrical permanent magnet structure with a minimum distortion of the field inside the magnet cavity and a minimum field leakage outside of the magnet.

It is a further object of this invention to provide a perfect termination for a closed magnet.

It is another object of the invention to provide a magnetic structure termination for the partial closing of a structure of multiple concentric layers.

SUMMARY OF THE INVENTION

The foregoing objects are achieved in accordance with the present invention by a termination design for a permanent magnet construction wherein no flux of magnetic induction is generated in the termination. This is achieved by establishing the magnetic field of the permanent magnet so as to coincide with the coercive force of the magnetic material of the termination. This is in turn established, physically, by orienting the interface between the cylindrical structure of the magnet and the termination so as to be parallel to the magnetic induction within the cylindrical structure. Specifically, a permanent magnetic structure comprising a cylindrical body and a termination, said cylindrical body being composed of magnetized material causing a magnetic field and flux of magnetic induction within said cylindrical body, said termination being composed of magnetic material, said cylindrical body oriented with respect to said termination such that the interface between said cylindrical body and said termination is parallel to said magnetic induction of said cylindrical body, and wherein said termination structure includes a transition structure and an end structure, said transition structure positioned between said cylindrical body and said end structure, said transition structure being magnetized in a plane perpendicular to the z axis of said cylindrical body, and said end structure transforming said field configuration in said cylindrical into the field configuration of said end structure, al so there are two concentric cavity defining magnets, each having a termination, each said termination having an opening, said opening each being of the same size in one dimension and equal to the size of said cavity in the same dimension.

BRIEF DESCRIPTION OF THE DRAWINGS

The foregoing summary and following detailed description of the invention will become more apparent with reference to the attached drawings, wherein.

DETAILED DESCRIPTION OF THE INVENTION

Figure 1:
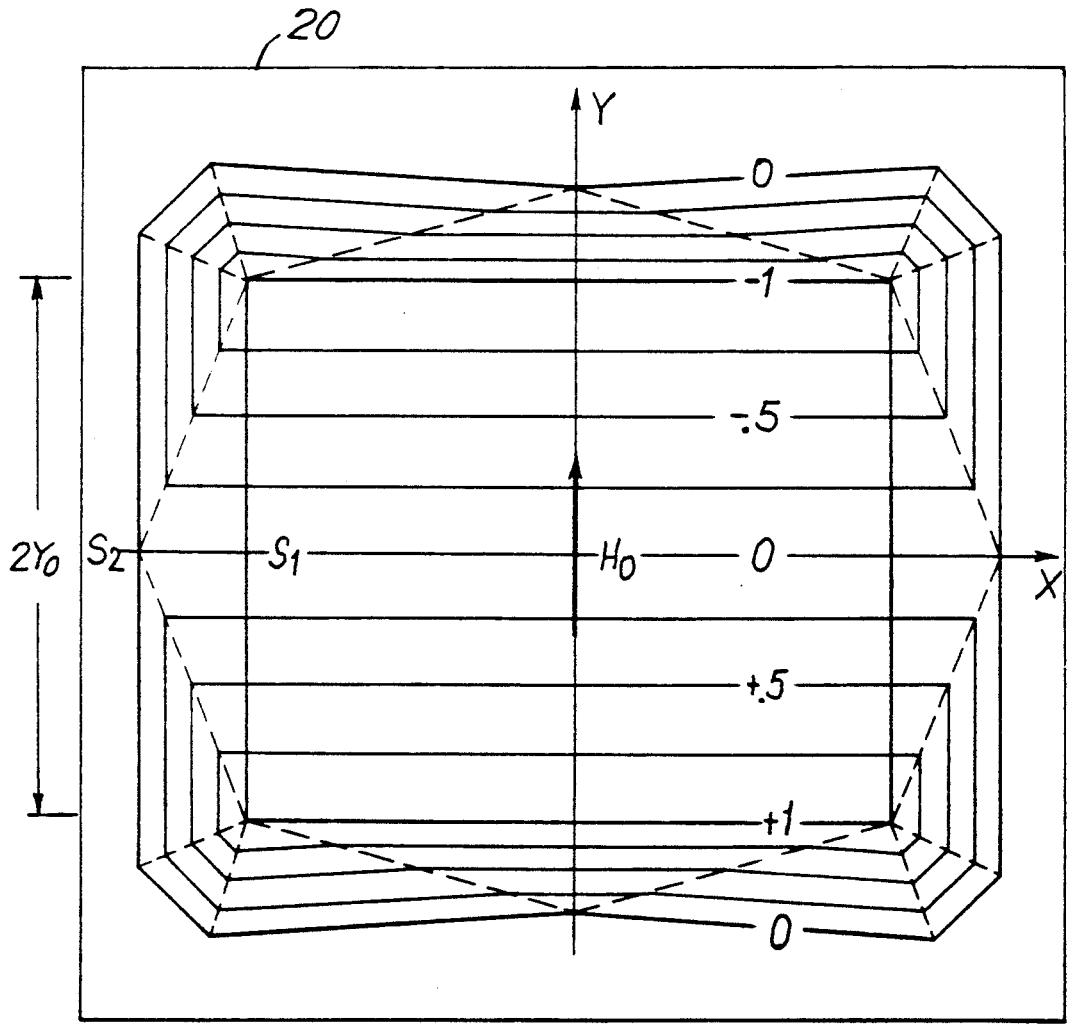
FIG. 1 shows a field diagram of a magnet with a cavity.

Although the design methodology applies to an arbitrary geometry of a cylindrical magnet structure, for simplicity of graphical presentation consider the structure of FIG. 1, which shows a magnet designed to generate a uniform field $H_o$ within a cylindrical cavity of a rectangular cross-section $S_1$.$H_o$ is oriented along the axis y of the frame of reference x, y, z where z is the axial coordinate of the magnet. The magnetized material is distributed between $S_1$ and an external surface of cross-section $S_2$. In general, the design of the cylindrical magnet may follow two radically different approaches. In one approach surface $S_2$ is assumed to be the interface between the magnetized material an external material 20, such as an external yoke of high magnetic permeability. In a second design approach $S_2$ is the interface between the magnetized material with air constituting the external material 20. In this second approach the distribution of magnetization is such that the magnetic induction B at the surface $S_2$ is parallel to the surface and consequently the flux of B is totally contained within the magnet without the use of a magnet yoke. In either case $S_2$ may be considered a surface of zero magnetostatic potential, and no field is found outside $S_2$.

Assume that the magnet of FIG. 1 is designed to generate a magnetic field $$\mu_o H_o = K J_o$$

where $J_o$ is the magnitude of the residual magnetization throughout the magnetic material; $\mu_o$ is the magnetic permeability of a vacuum and K is a positive number:

$$K\mu 1$$

FIG. 1 shows the distribution of the equipotential lines within $S_2$. Because of the symmetry of the geometry of FIG. 1, the magnetostatic potential is zero on the plane y=0 and it is assumed that it is equal to ±1 on the two sides of the internal rectangle parallel to the x axis.

Assume now a magnet of finite length which contains a section of the cylindrical structure of FIG. 1. Assume also that the terminations of the magnet at both ends of the cylindrical structure form a closed configuration of magnetized material. The design of the closed magnet is aimed at confining the magnetic field within the volume of the magnet, without modifying the field configuration within the cavity of the cylindrical section of FIG. 1.

This invention presents an approach to the design of the termination based on a distribution of magnetization such that no flux of magnetic induction is generated in the termination. This is achieved if the magnetic field H and the residual magnetization J are such that $$\mu_o H = -J$$

i.e. if the magnetic field coincides with the coercive force of the magnetic material of the termination. In order to satisfy this relationship the interface between the cylindrical body of the magnet and the termination must be parallel to the magnetic induction within the cylindrical structure. Hence the interface must be a plane perpendicular to the z axis.

If the foregoing equation is satisfied, the geometry of the terminations and its magnetization must be such that the tangential component of the magnetic field is continuous at each point of the interface. Furthermore, the external surface of the terminations (i.e. the interface between termination and surrounding air) must be a surface of a zero magnetostatic potential whose boundary coincides with the line $S_2$ of FIG. 1.

Figure 2:
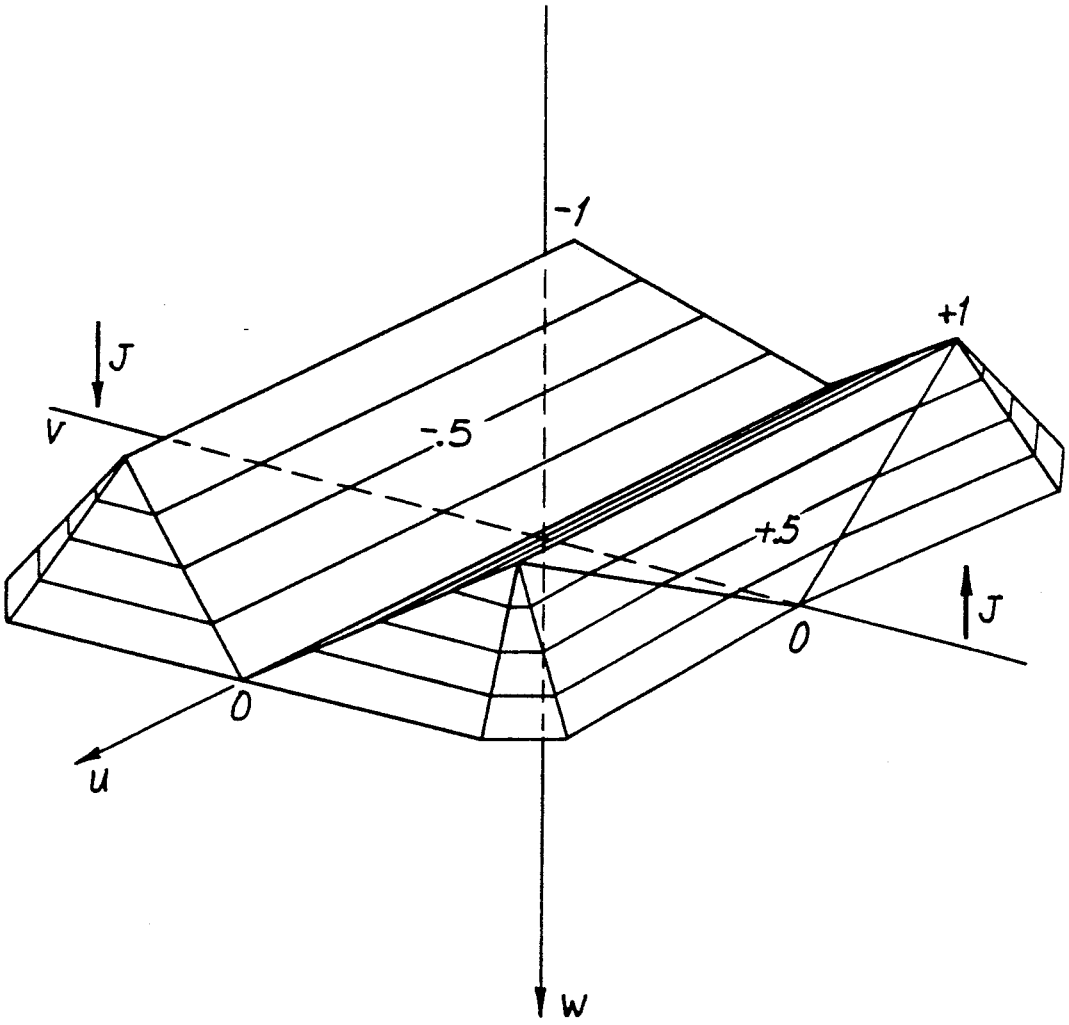
FIG. 2 shows a variation of the structure of FIG. 1.

The principle of the termination design is to consider the equipotential lines of FIG. 1 as the contour lines of a volume of magnetic material magnetized in the direction of the axis z. Positive and negative values of the magnetostatic potential would correspond to positive and negative elevations with respect to the plane $\dot{O}=0$. By reversing the direction of J in the region y>0, y<0 the elevation would not change sign as shown in FIG. 2. Axis w of the frame of reference u, v, w of FIG. 2 coincides with the axis z of FIG. 1 and u, v are parallel to x, y respectively. The equipotential surfaces in FIG. 2 are parallel to the plane w=o where $\dot{O}=0$. Hence the plane w=o may be the interface between the termination and the air surrounding the magnet; and the w axis is oriented toward the outside region.

Assume that the magnitude of the residual magnetization J in the structure of FIG. 2 is equal to the magnitude $J_o$ of the magnetization of the magnetic material of FIG. 1. Then by virtue of Eqs 1, 2, the elevation of $w_o$ of the lines O=±1 is related to the dimension $y_o$ of the magnet cavity by $$\frac{w_o}{y_o} = K$$

As previously stated, the interface between termination and cylindrical section must be a plane surface perpendicular to the z axis. Assume that this surface coincides with the plane $$w = -w_o$$

in FIG. 2. A transition structure of magnetic material must fill the space around the end structure of FIG. 2 between the planes w=0 and $w=-w_o$. The magnetization of the transition structure must generate a transition configuration of magnetic field between the field in the cylinder and the field in the end structure.

Figure 3:
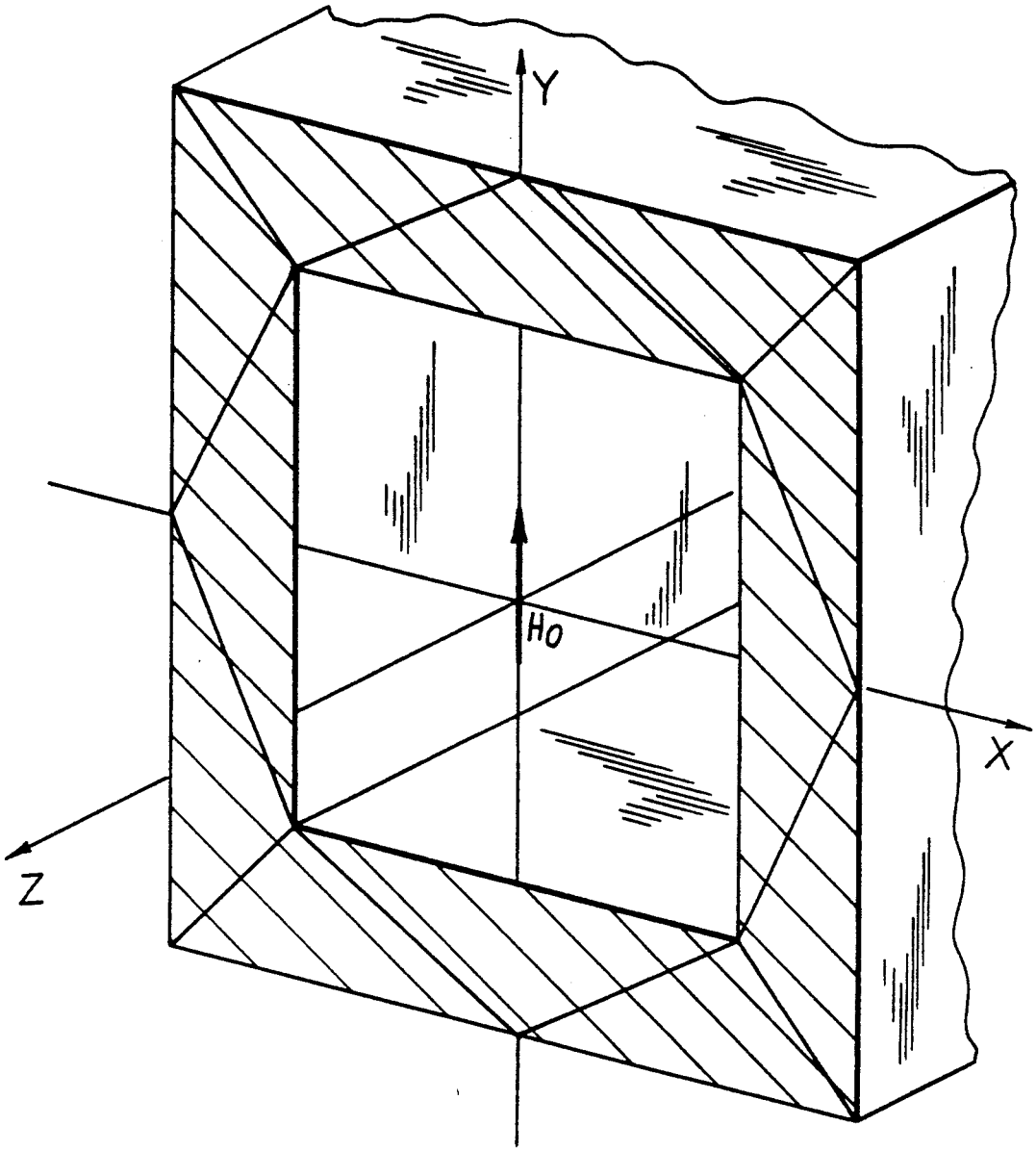
FIG. 3 shows a square cross-section.

In order to present the design of the transition structure in a quantitative way, assume the example of FIG. 3 where the magnet is designed around a square cross-section $s_1$ for a value of M $$M = 1 - \frac{1}{\sqrt{2}}$$

Figure 4:
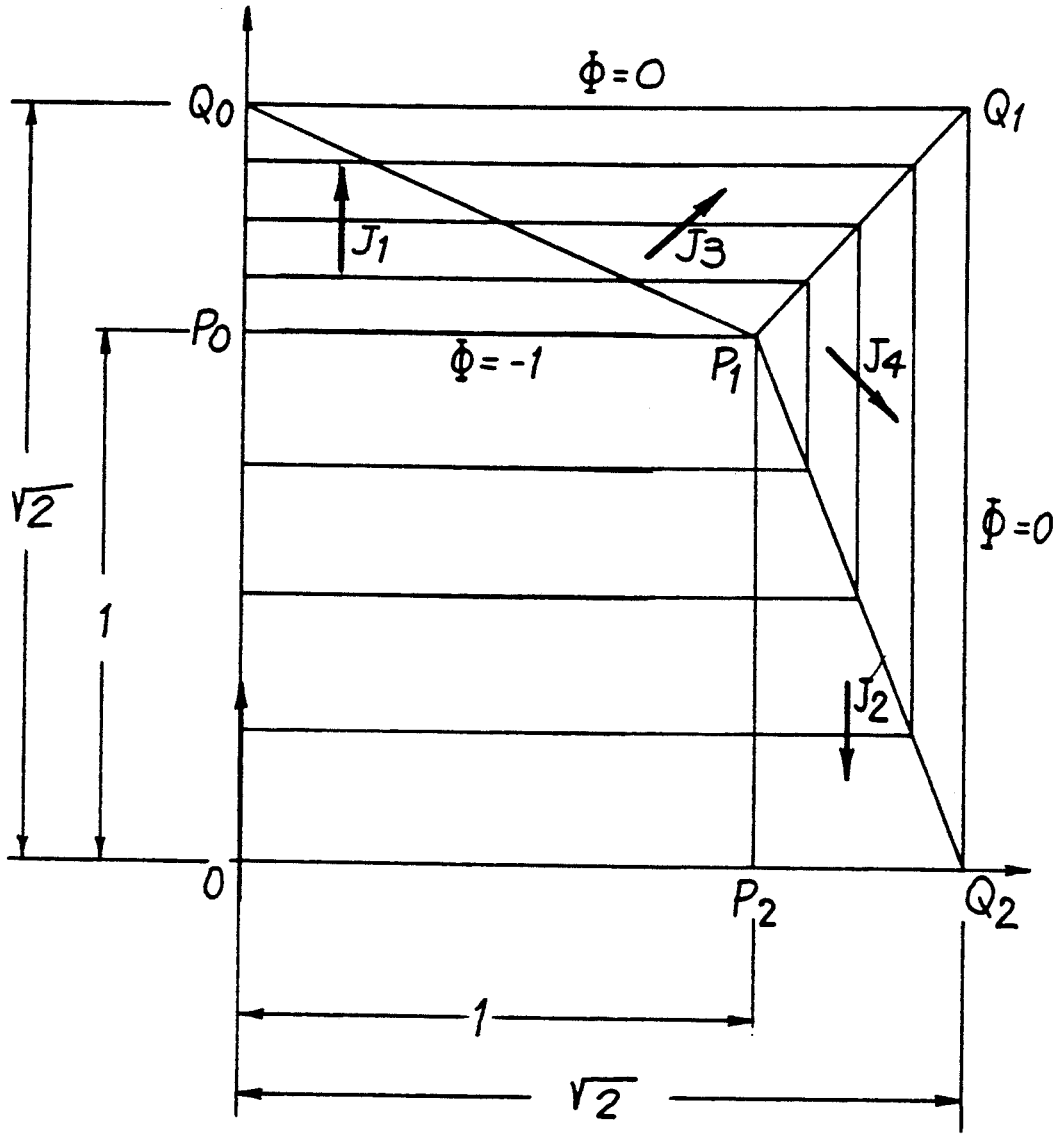
FIG. 4 shows a quadrant of FIG. 3.

In this particular case $S_2$ also is a square cross-section and the side of $S_2$ is equal to $\sqrt{2}$ times the side of $s_1$. FIG. 4 shows the first quadrant of the cross section of FIG. 3, with the orientation of the magnetization $\vec{J}$ in the four elements of magnetic material. One has $$-\vec{J_2} = +\vec{J_1} = \frac{\mu_o}{M}\vec{H_o}$$

Figure 5:
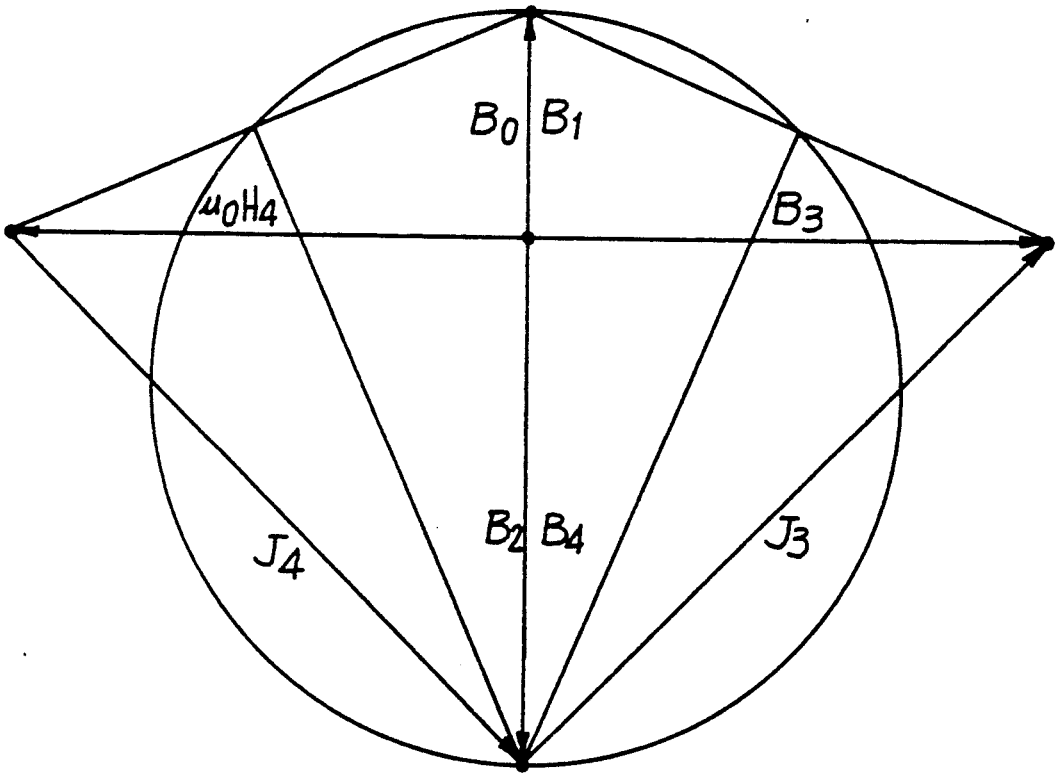
FIG. 5 shows a vector diagram of the forces of FIG. 4.

The values of $\vec{J}_3$, $\vec{J}_4$ are given by the vector diagram of FIG. The four magnetization vectors have the same amplitude $J_o$. FIG. 5 also shows the values of the magnetic induction $\vec{B}$ in the first quadrant. One has $$\vec{B_o} = \mu_o \vec{H_o} = \mu_o \vec{H_2}$$

$$\vec{B_2} = \mu_o \vec{H_3} = \mu_o \vec{H_3}$$

Figure 6:
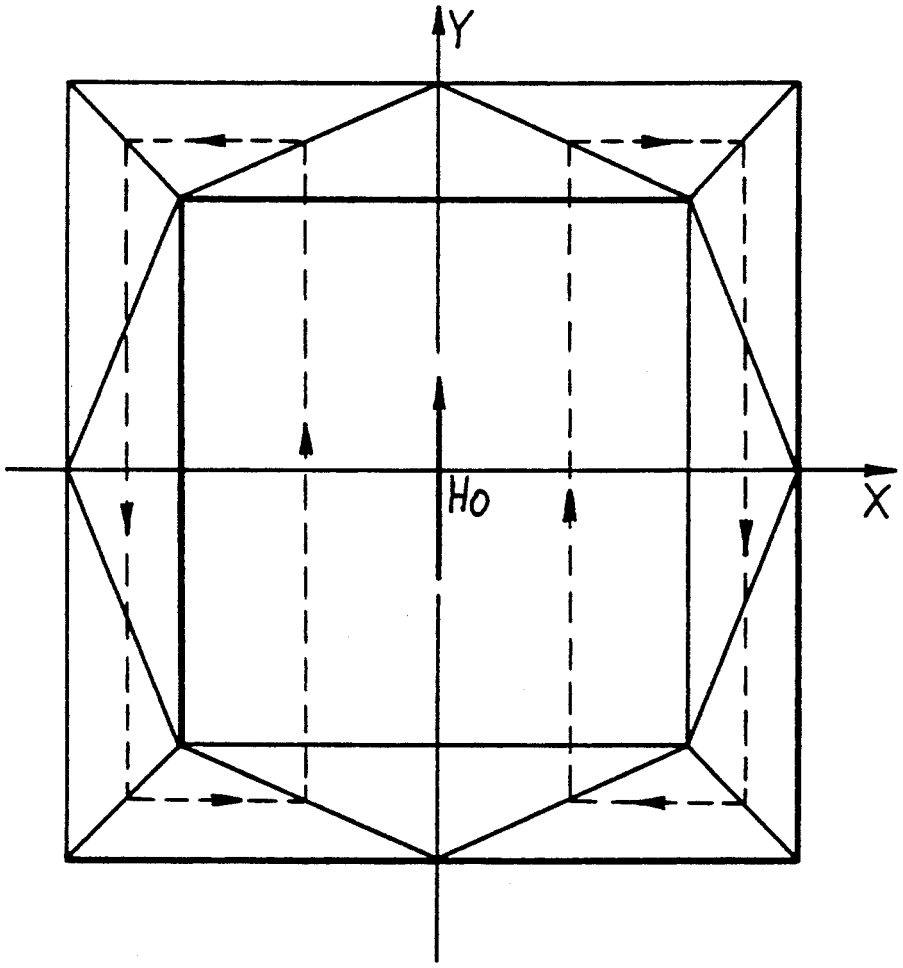
FIG. 6 shows two lines of flux of the structure of FIG. 3.
Figure 7:
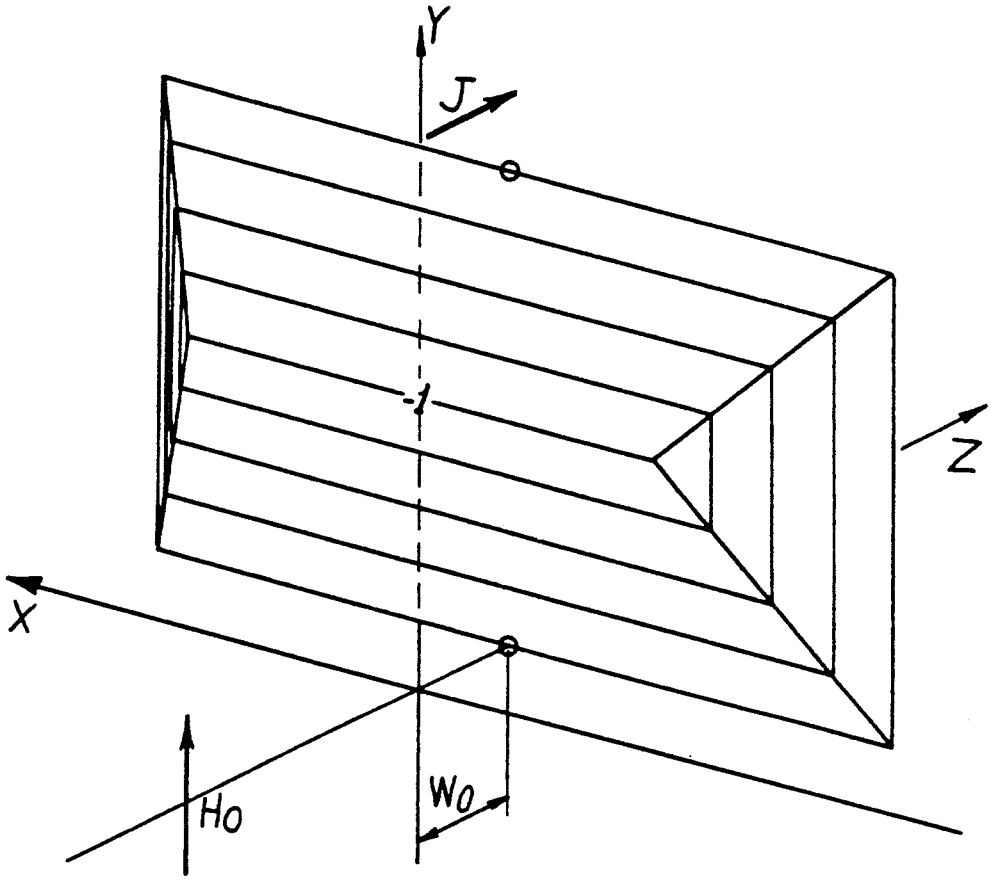
FIG. 7 shows one half of the end structure of FIG. 2.
Figure 8:
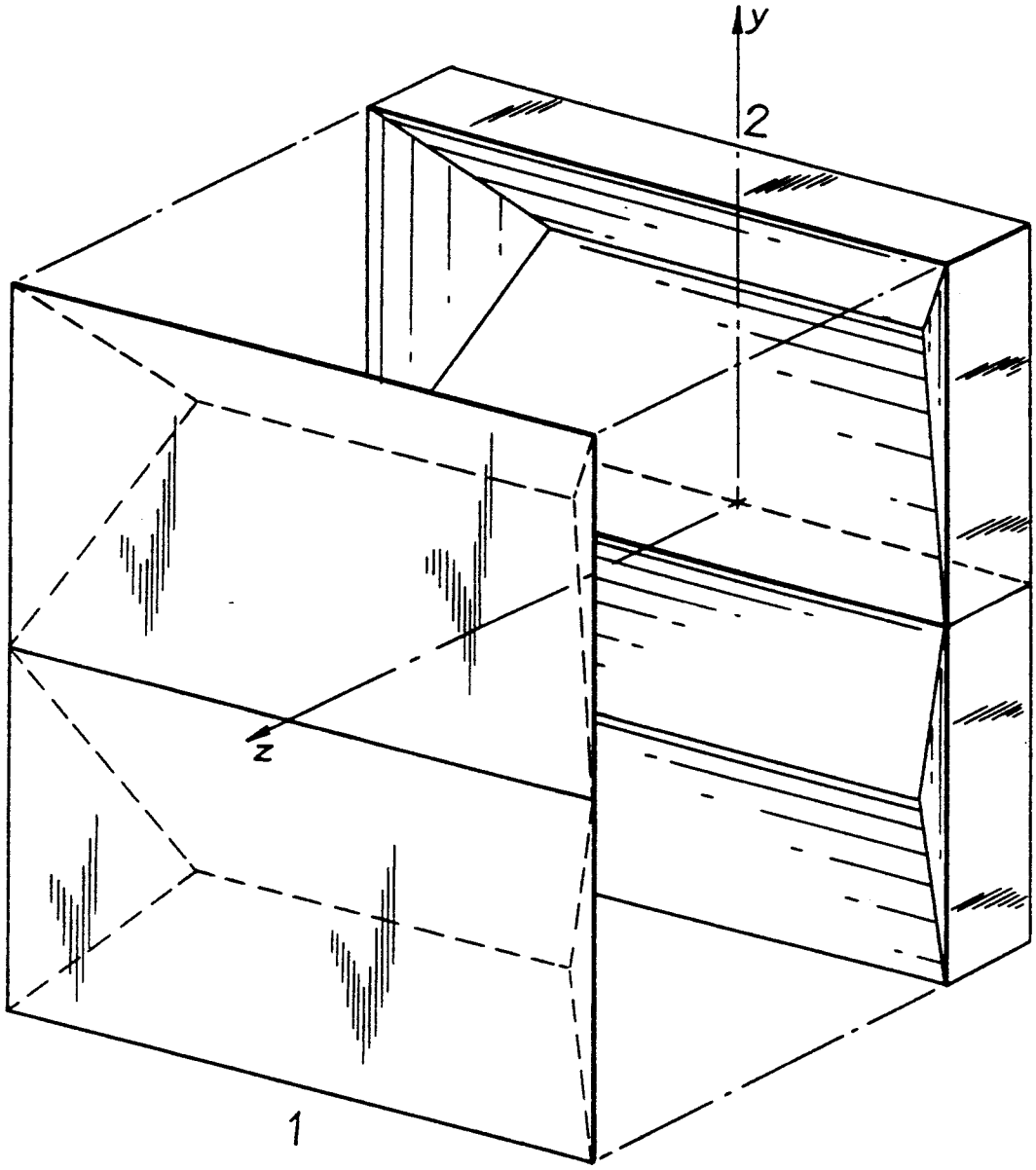
FIG. 8 shows a view of end structure removed from a transition structure.

Two lines of flux of $\vec{B}$ in the cross-section of the cylindrical magnet of FIG. 3 are shown in FIG. 6. FIG. 7 shows one half of the end structure of FIG. 2 located in the y>0 region. FIG. 8 shows the end structure (1) removed from the transition structure (2). The details of the transition structure are shown in the following FIG. 9-10-11.

Figure 9:
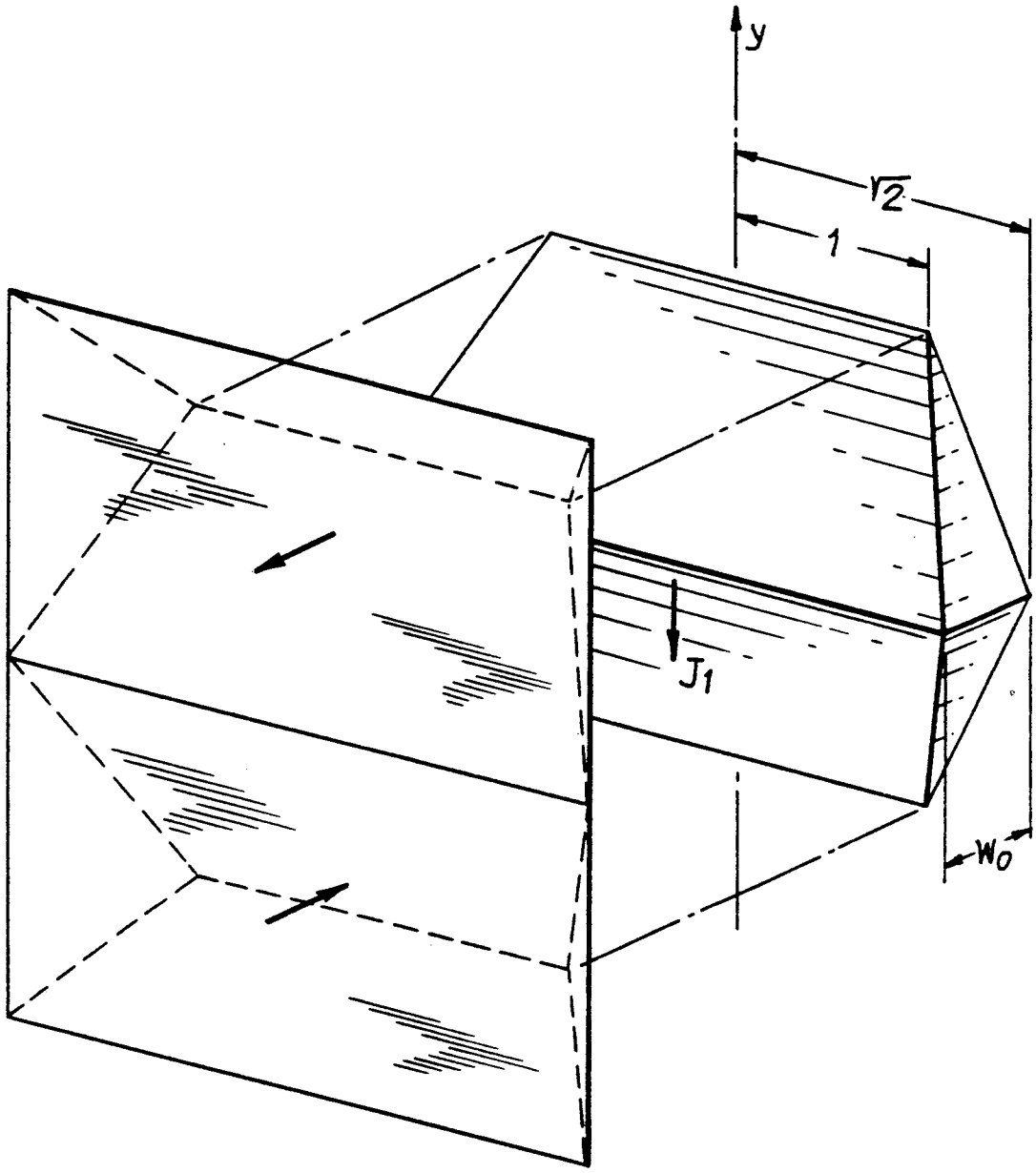
FIGS. 9–11 show partial views of the structural components of FIG. 8.

The basic difference in the magnetization of the two components of the termination is that the elements of the end structure are magnetized along the z axis, while the elements of the transition structure are magnetized in a plane perpendicular to the z axis. One component of the transition structure establishes the interface with the internal cavity of the magnet. In the first quadrant of the magnet cross-section, this component also matches the boundary condition with the element of magnetization $\vec{J}_2$. This component is shown in FIG. 9 removed from the end structure and it is shown again in FIG. 10 removed from the other elements of the transition structure. Its magnetization $\vec{J}_i$ is oriented in the negative direction of the y axis and its magnitude is related to the magnitude $J_o$ of the magnetization in FIG. 4 by the equation $$J_i = MJ_o$$

Figure 10:
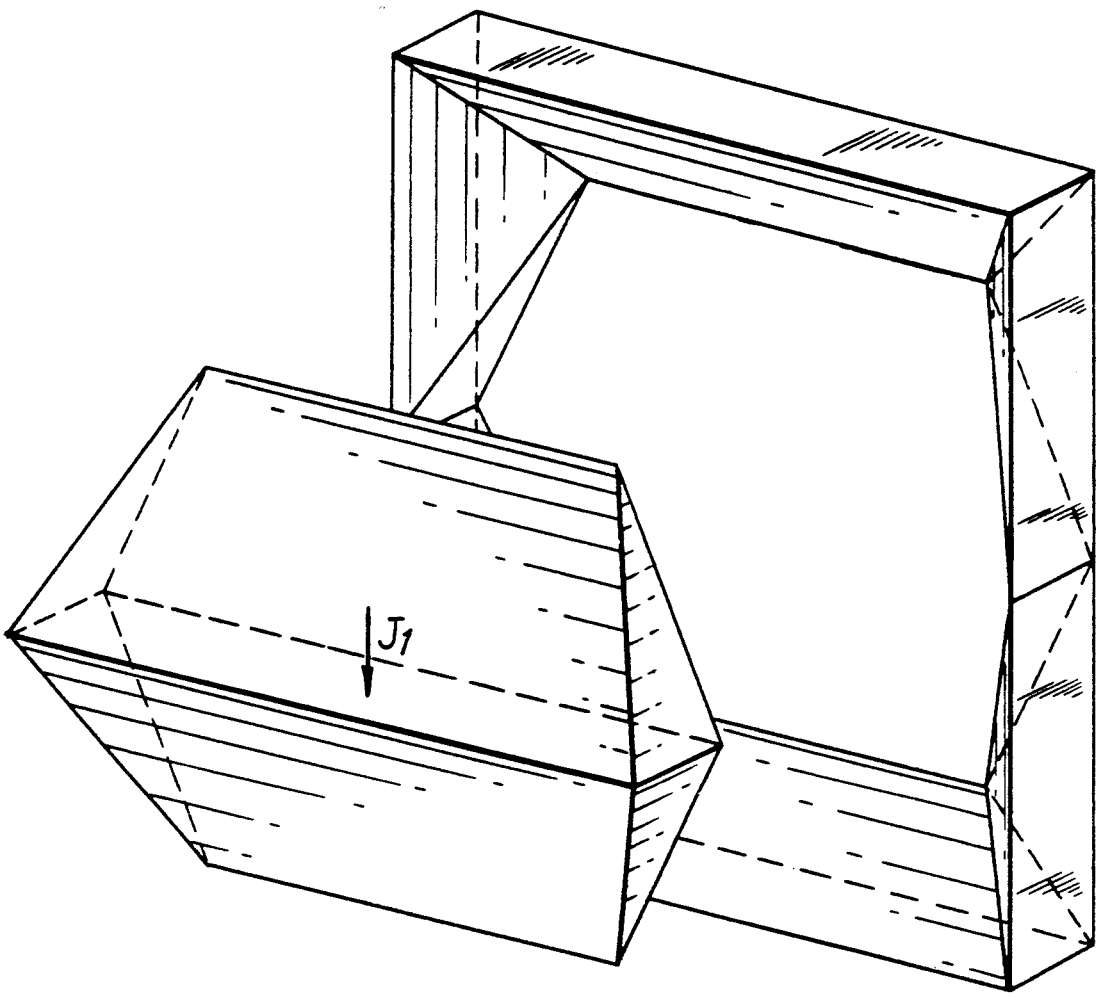
Figure 11:
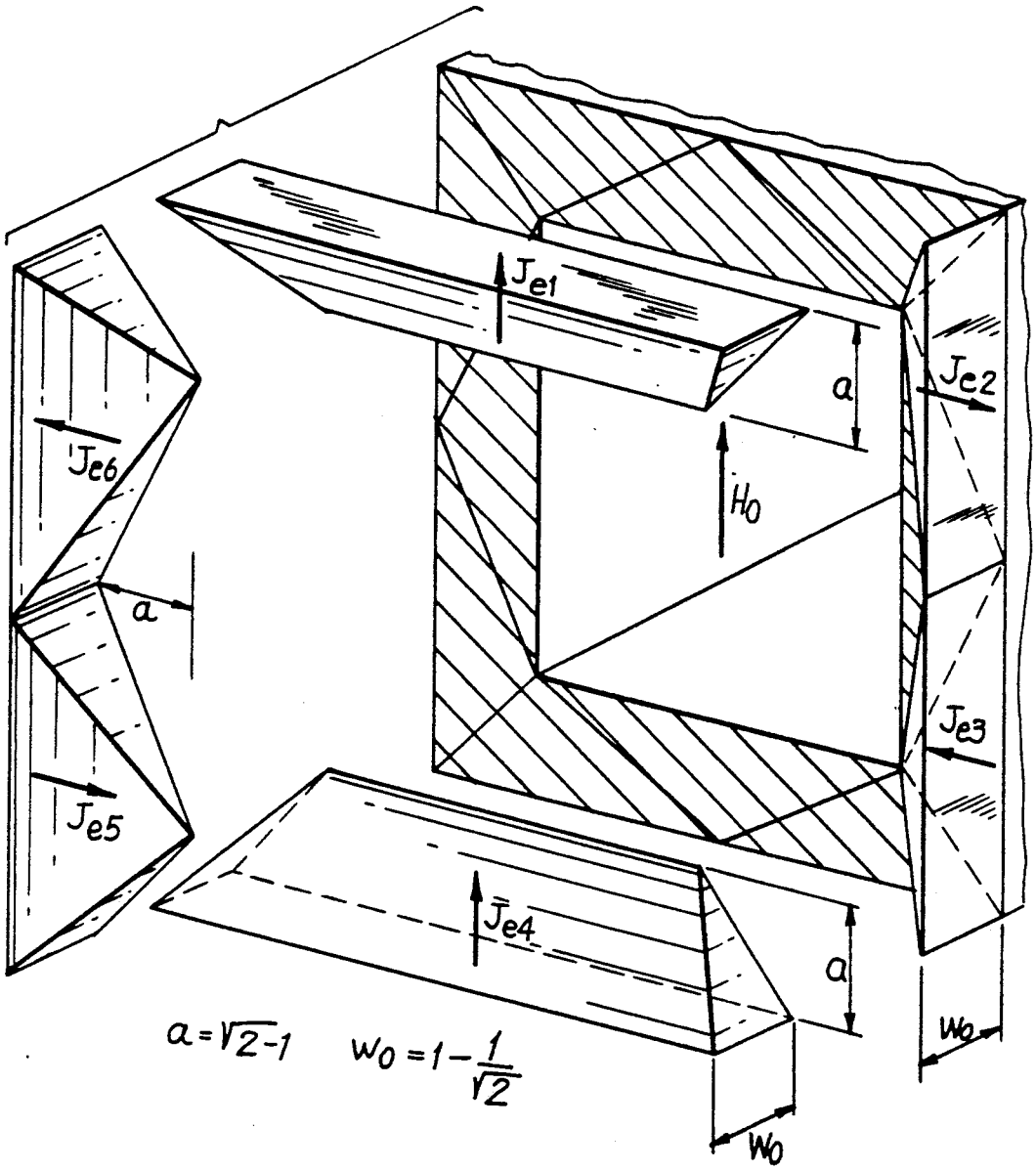

FIG. 11 shows the exploded view of the ring structure of FIG. 10, which interfaces with the magnetic elements of the cylindrical section of the magnet.

Because $\vec{H}_1 = \vec{H}_3$ in the example of FIG. 3, only one value of magnetization $J_{ei}$, as shown in FIG. 11, is required to match the boundary conditions between the transition unit and the elements of the cylindrical structure with magnetizations $\vec{J}_1$ and $\vec{J}_3$. Obviously the same consideration applies to the four quadrants of the cross-section, leading to the two elements of the transition unit with magnetization $\vec{J}_{ei}$, $\vec{J}_{e4}$. Vectors $\vec{J}_{ei}$, $\vec{J}_{e4}$ are oriented in the positive direction of the y axis and their magnitude is $$J_{e1} = J_{e4} = J_e = (1-K)J_o$$

In FIG. 11, the pentahedron with magnetization $J_e$ matches the boundary condition with the element of FIG. 6 with magnetization $\vec{J}_4$. Vector $\vec{J}_{e2}$ is oriented in the positive direction of the x axis and its magnitude is $$J_{e2} = (1-K)J_o$$

Because of symmetry conditions, the other three elements which complete the transition unit are magnetized with magnetizations $\vec{J}_{e3}$, $\vec{J}_{e5}$, $\vec{J}_{e6}$ which satisfy the conditions $$J_{e3} = -J_{e5} = J_{e6} = -J_{e2}$$

Thus the cylindrical section of FIG. 3, terminated at both ends with the structure of FIG. 8, generates a uniform magnetic field $\vec{H}_o$ inside the cylindrical cavity, and no magnetic field outside of the magnet.

Figure 12:
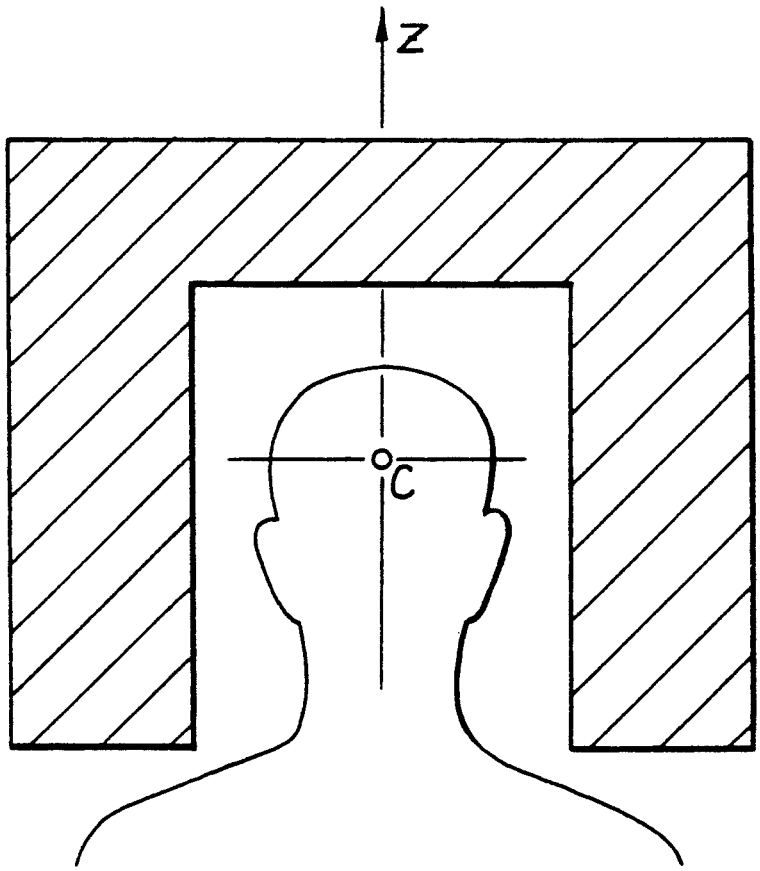
FIG. 12 shows a view of a partially open termination structure.

As previously stated, a magnet designed for clinical applications must be partially open to accept a patient. One end of the cylindrical section can still be closed with the termination described in the previous section, if the magnet is designed for a NMR head scanner, as indicated by the schematic of FIG. 12, where center C of the region of interest is close to the center of the brain.

Figure 13:
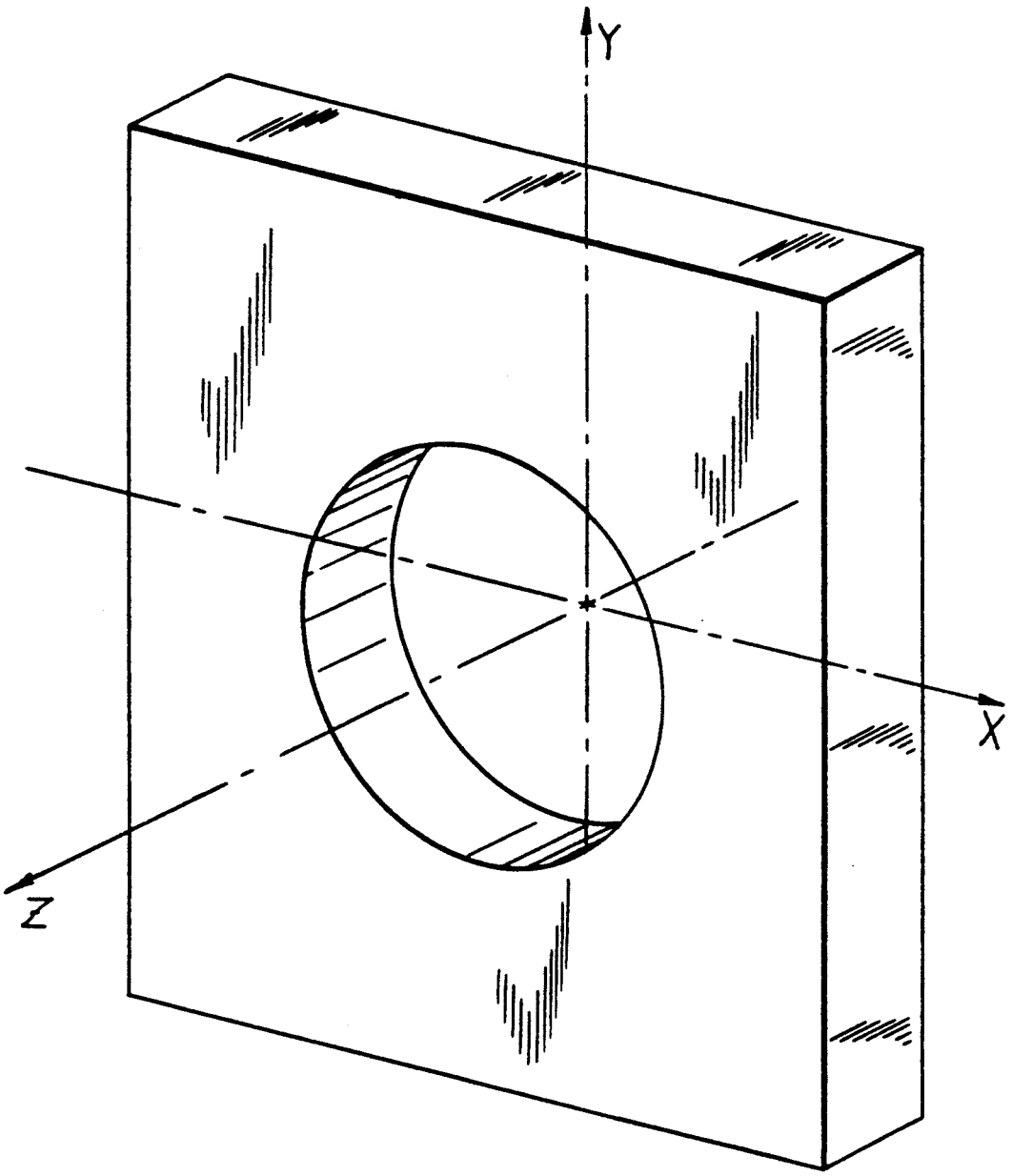
FIG. 13 shows a partially open magnet structure.

Assume that the magnet is opened through the termination as shown in the schematic of FIG. 13 and assume that the opening goes through the elements of the termination shown in FIG. 8 only. Thus the opening is smaller or equal to the cross-section of the cylindrical structure of the magnet.

The field distortion resulting from the opening of FIG. 13, is given by the field generated by a distribution of magnetic surface charges equal and opposite to the charges induced by the magnetization vectors $\vec{J}$, $-\vec{J}$ and $\vec{J}_i$ computed in Section 2a at the interfaces of the elements of FIG. 8 within the opening.

Assume a rectangular cross-section of the opening with dimensions $2x_s$, $2y_s$ with the condition $$x_s \mu 1,\ y_s \mu 1$$

Figure 14:
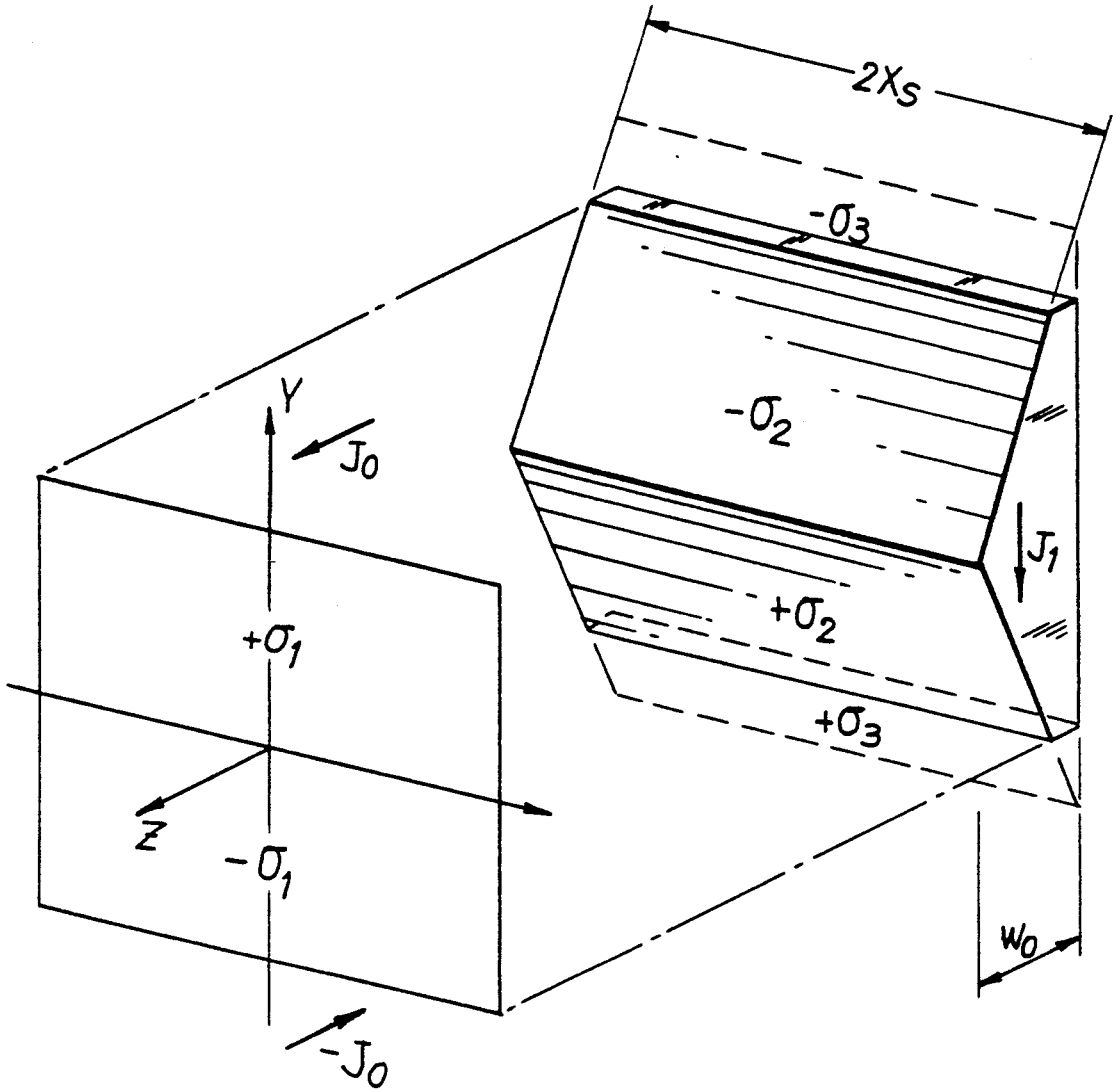
FIG. 14 shows certain structural interfaces.

FIG. 14 shows separately the interface between the end structure and the surrounding air, and the interface between the end structures and the element of the transition structure with magnetization $\vec{J}_i$.

The surface charge densities $ps_1$ induced on the interface between end structure and surrounding air are given by $$s_1 = J_o$$

Surface charge densities $\pm S_2$ induced on the interface between end structure and transition structure are given by the component of the magnetization perpendicular to the interface, i.e.

$$S_2 = J_o \cos a + Ji \sin A$$

where, by virtue of Eq. 4

$$\tan\text{Å} = K = 1 - \frac{1}{\sqrt{2}}$$

Surface charges $\pm s_3$ induced on the interface resulting from the intersection of planes $y = \pm y_s$ with the elements magnetized at $\vec{J}_i$ are given by $$S_3 = J_i$$

The equivalent dipole moment due to the charges induced by magnetization $J_o$ on the interfaces of the end structure vanish. The equivalent dipole moment due to the distribution of charges induced by $J_i$ is $$m = J_o^{K2} x_x y_s (2 - y_s)$$

which shown that m is proportional to the square of parameter K, and has a maximum value for $y_s = 1$, i.e. for dimension of the opening along the y axis equal to the side of the square cross-section of the cylindrical portion of the magnet.

Figure 15:
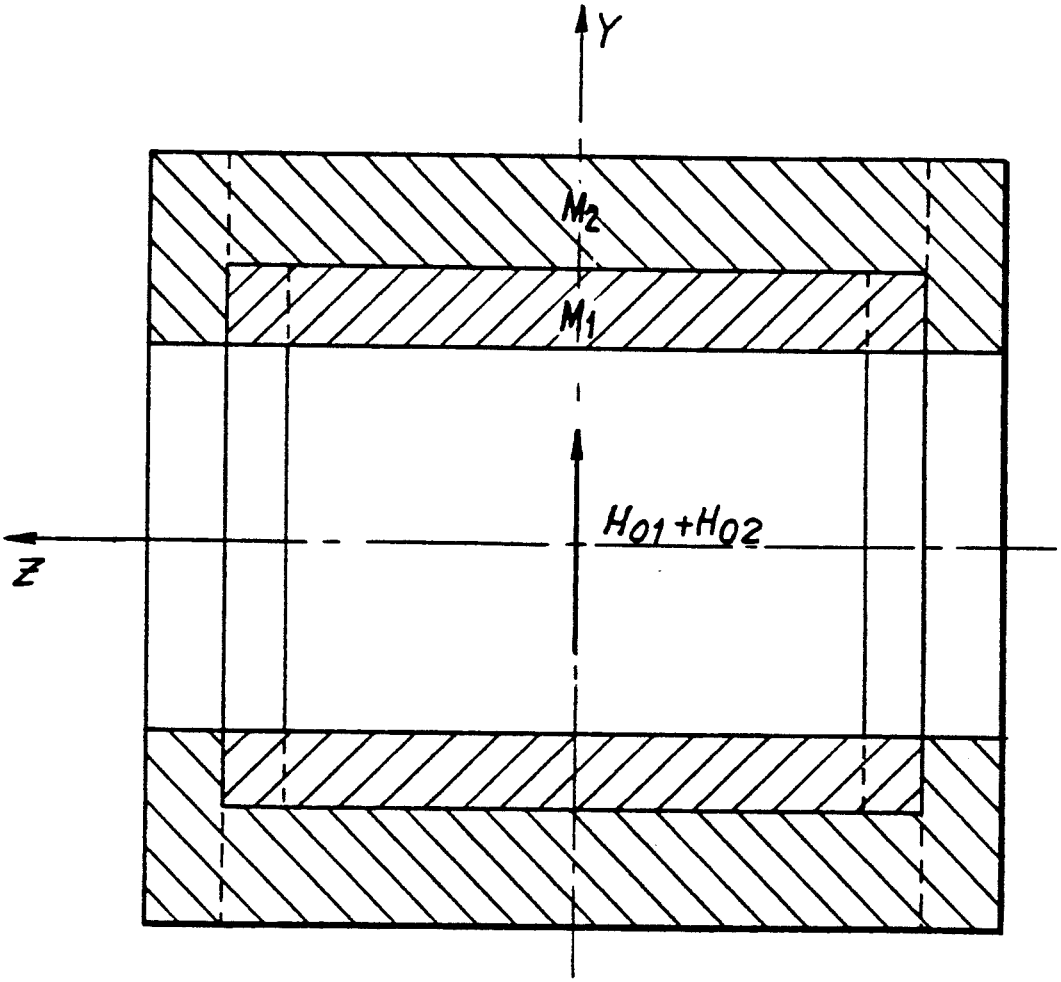
FIG. 15 shows a system of concentric magnets, each with partially closed terminations.

Hence if the termination is partially open according to the schematic of FIG. 14, the termination design defined in section 2a leads to a field distortion and a stray field outside of the magnet which decrease rather rapidly as K decreases. As a consequence it is of advantage to design the magnet as a structure of concentric magnets each of them designed for a relatively small value of K, according to the schematic of FIG. 15, which shows a system of concentric magnets, each of them with a partially closed termination. In FIG. 15, the two magnet terminations have the same opening with y dimensions equal to the y dimension of the internal cavity of magnet $^{K1}$. The magnet field at each point of the system of multiple concentric magnets is the linear superposition of the field generated by each magnet.

Figure 16:
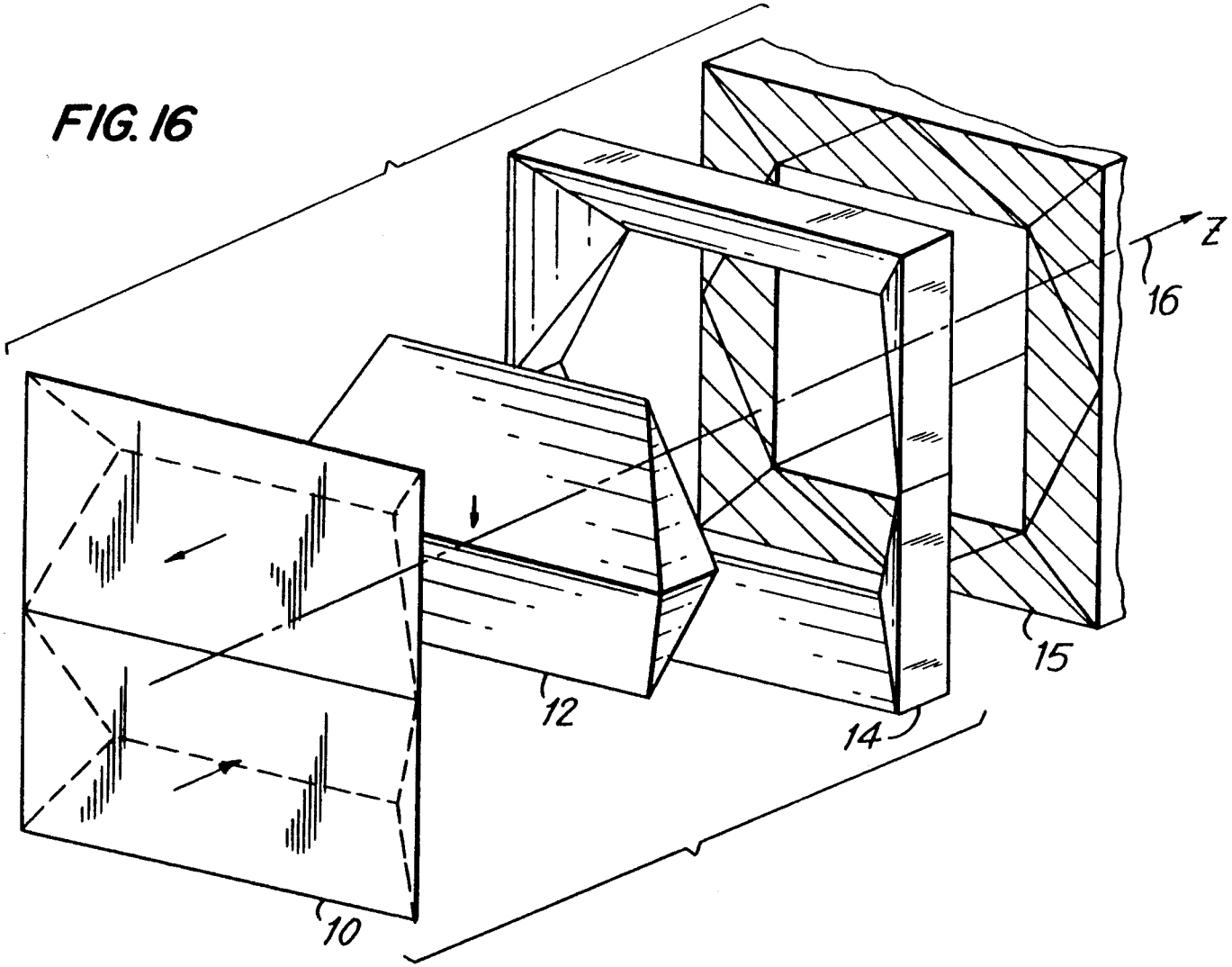
FIG. 16 shows an exploded view of an assembly of magnetic structures with a closed termination.

FIG. 16 shows an exploded view of a magnetic structure with a closed termination. The structure includes a first end piece 10, a second end piece 12, an open frame transition piece 15, and the main structure of the magnetic cylinder structure 14. The Z axis 16 is shown as a transverse passing along the center of all of the structural elements. Each piece is prismatic, as shown, with magnetic anentations as indicated by the arrows. The combination prismatic structure and the magnetic orientation of each prisim result in a geometry wherein the interface between the cylindrical structure and the termination are parallel to the magnetic induction within the cylindrical structure. As a result, no field escapes and no magnetic force is lost.

In FIG. 16, the surrounding or external medium can be a ferromagnetic material, air, or non magnetic medium, or a combination thereof.

Other variations, additions, modifications and substitutions to the invention will be apparent to those skilled in the art, and should be limited only by the following appended claims.

What is claimed is:

1. A permanent magnetic structure comprising a cylindrical body and a termination, said cylindrical body being composed of magnetized material causing a magnetic field and flux of magnetic induction within said cylindrical body, said termination being composed of magnetic material, said cylindrical body oriented with respect to said termination such that the interface between said cylindrical body and said termination is parallel to said magnetic induction of said cylindrical body, one portion of said termination being magnetized in a direction parallel to said interface and another portion of said termination being magnetized in a direction perpendicular to said interface.

2. The structure of claim 1 wherein said interface is a plane perpendicular to the z axis of said cylindrical body.

3. The structure of claim 2 wherein the tangential component of said magnetic field is continuous at each point of said interface, no magnetic induction is generated in said termination by the cylindrical body and no magnetic induction is generated in said termination by the magnetic material of said termination.

4. The structure of claim 1 wherein the external surface defined by both the cylindrical body and said termination is a surface of zero magnetic potential, there being no flux of magnetic induction across said surface, said external surface being the interface between said structure and an external medium.

5. The structure of claim 4, wherein said external medium is air.

6. The structure of claim 4, wherein said external medium is a ferromagnetic material.

7. The structure of claim 6, wherein said external medium is composed of different medium including ferromagnetic material.

8. A permanent magnetic structure comprising a cylindrical body and a termination, said cylindrical body being composed of magnetized material and having an internally generated magnetic field, causing magnetic induction with said cylindrical body, said termination being composed of magnetic material, said cylindrical body oriented with respect to said termination such that the interface between said cylindrical body and said termination is parallel to said magnetic induction within said cylindrical body, whereby no flux of magnetic induction is generated in said termination and wherein said termination structure includes a transition structure and an end structure, said transition structure being positioned between said cylindrical body and said end structure, said transition structure being magnetized in a plane perpendicular to the z axis of said cylindrical body, and said end structure being magnetized in a plane parallel to the z axis.

9. The structure of claim 8 wherein there are a multiplicity of concentric magnets, around the same cavity, each of said magnets having a termination.

10. The structure of claim 8 wherein there are a multiplicity of concentric magnets, around the same cavity, each of said magnets having a termination, each said termination having an opening, each said opening each being of the same size in one dimension and equal to the size of said cavity in the same dimension.

11. A permanent magnetic structure comprising a cylindrical body and a termination, said cylindrical body being composed of magnetized material causing a magnetic field and flux of magnetic induction within said cylindrical body, said termination being composed of magnetic material, said cylindrical body oriented with respect to said termination such that the interface between said cylindrical body and said termination is parallel to said magnetic induction within said cylindrical body, and wherein said termination structure includes a transition structure and an end structure, said transition structure positioned between said cylindrical body and said end structure, said transition structure being magnetized in a plane perpendicular to the z axis of said cylindrical body, and said end structure transforming said field configuration in said cylindrical body into the field configuration of said end structure.

12. The structure of claim 11 wherein there are a multiplicity of concentric magnets, around the same cavity, each said magnet having a termination, each said termination having an opening, each said opening each being of the same size in one dimension and equal to the size of said cavity in the same dimension.

13. A permanent magnetic structure comprising a cylindrical body and a termination, said cylindrical body being composed of magnetized material causing a magnetic field and flux of magnetic induction within said cylindrical body, said termination being composed of magnetic material, said cylindrical body oriented with respect to said termination such that the interface between said cylindrical body and said termination is parallel to said magnetic induction within said cylindrical body, said termination being magnetized in a direction such that its external surface, away from said cylindrical body, is a surface of zero magnetostatic potential.

* * * * *